US005478279A

United States Patent [19]

McCormick

[11] Patent Number: 5,478,279

[45] Date of Patent: Dec. 26, 1995

[54] MULTIPLE PLY PAPER ROLL

[75] Inventor: Joseph A. McCormick, Manhattan, Ill.

[73] Assignee: General Credit Forms, Inc., Earth City, Mo.

[21] Appl. No.: 168,062

[22] Filed: Dec. 15, 1993

Related U.S. Application Data

[63] Continuation of Ser. No. 968,378, Oct. 29, 1992, abandoned, which is a continuation-in-part of Ser. No. 873,451, Apr. 24, 1992, abandoned.

[51] Int. Cl.[6] ..... B41L 1/20

[52] U.S. Cl. ..... 462/25; 283/60.1

[58] Field of Search ..... 462/25, 26, 6, 462/28; 281/2, 5; 428/40–43; 283/60.1, 60.2

[56] References Cited

U.S. PATENT DOCUMENTS

| | | | |
|---|---|---|---|
| 543,330 | 7/1895 | Breakspear | 462/25 |
| 3,877,728 | 4/1975 | Herz | 281/5 X |
| 4,357,380 | 11/1982 | Schnug | 281/5 X |

FOREIGN PATENT DOCUMENTS

| | | | |
|---|---|---|---|
| 1055426 | 2/1954 | France | 462/26 |
| 8501916 | 5/1985 | WIPO | 462/26 |
| 8607314 | 12/1986 | WIPO | 462/26 |

*Primary Examiner*—Willmon Fridie, Jr.

*Attorney, Agent, or Firm*—Marshall, O'Toole, Gerstein, Murray & Borun

[57] ABSTRACT

The invention encompasses multiple-ply carbonless paper rolls having the plies adhesively joined along at least one edge of the roll. Advantageously, the individual plies remain adhered together when the plies are unwound and separated from the main roll but are still relatively easy to separate from each other.

22 Claims, 2 Drawing Sheets

MULTIPLE PLY PAPER ROLL

CROSS-REFERENCE TO RELATED APPLICATION

This is a Continuation of U.S. application Ser. No. 07/968,378, filed Oct. 29, 1992, now abandoned, which is a continuation-in-part of, commonly assigned application Ser. No. 07/873,451 filed Apr. 24, 1992, now abandoned.

FIELD OF THE INVENTION

The invention is generally directed to a paper roll defining at least one imprintable form typically used to record retail sales transactions comprising multiple layered plies. More specifically, the invention encompasses a small paper roll having two or more stacked or layered carbonless paper plies adhesively joined along at least one longitudinal edge of the roll so that portions of the multiple plies may be kept together and properly aligned after being separated from the main paper roll.

BACKGROUND OF THE INVENTION

Carbonless, multiple ply business forms generally include a number of plies that provide a desired number of copies of the form. For two-ply forms, the top ply is most often a coated back ("CB") paper and the adjacent underlying ply is a coated front ("CF") paper. In such a two-ply form, the coated back paper is treated with a carbonless coating that contains rupturable microcapsules that are filled with reactive, colorless dyes. The coated front paper is treated with a resin adapted to react with the colorless dyes. When the microcapsules are ruptured to allow contact of the colorless reactive dye with the resin, a color changing reaction occurs that produces an image on the coated front sheet of the underlying ply.

For a three-ply form, the top ply is a coated back ply, the adjacent underlying ply is a coated front and back ("CFB") ply, and the bottom ply is a coated front ply. In the three-ply form, the middle ply is coated on both opposing surfaces such that the coated front allows images to be made on the middle ply and the coated back allows copies of such images to be made on the coated front bottom ply.

Forms having more than three plies are readily made by adding intermediate coated front and back plies to the form. For example, in a four-sheet form, the top ply is a coated back ply, two intermediate plies are coated front and back plies, and the bottom ply is a coated front ply.

For convenience, the multiple plies of carbonless forms are generally adhered together along a single longitudinal edge of the plies the adherence being referred to as edge padding. The adhesion of the plies to each other is accomplished using liquid adhesive compositions, conventionally referred to as "padding compounds," some of which selectively adhere only to surfaces coated with carbonless image producing compounds, allowing such surfaces to adhere to each other but not to surfaces which are free of such coatings. In some instances, an adhesive rejection solution is disposed over the top surface of the coated back (CB) ply and the bottom surface of a coated front (CF) ply by the manufacturer of the carbonless paper to assure that the padding compound does not adhere to such surfaces.

This property of selective adhesion allows forms manufacturers to bond or edge-pad (join sheets together along one edge) a large stack of sheets which have been collated to give a desired form. For example, the two sheets that are used to make a two-sheet form are collated into a stack having, from top to bottom, a coated back sheet, a coated front sheet, a coated back sheet, a coated front sheet, and so on. In this collated stack of two-sheet forms, the liquid adhesive composition only bonds a coated back sheet to the adjacent underlying coated front sheet. No bond is formed between the coated back sheet and the overlying coated front sheet in the collated stack. Thus, the liquid adhesive composition may be applied to one edge of the entire collated stack and, when the stack is dried and then fanned out, the stack spontaneously separates into individual two-sheet forms, each form being adhesively bonded together at one edge.

In such conventional, carbonless multiple-ply forms, however, each sheet is cut to its final size and shape before the sheets in each form are adhesively joined. Thus, such forms are not readily adapted to recordation or printing/imprinting systems which produce continuous variable sized or shaped forms or copies.

One common continuous feed printing/imprinting system that produces variable sized and shaped forms or copies from a common feedstock is a "point of sale" printing system manufactured by VeriFone. Retail sales transactions using credit cards are typically recorded on continuously fed two-ply carbonless paper rolls using standardized printing equipment such as supplied by VeriFone. A two-ply carbonless paper roll having one CB ply stacked or layered over the other CF ply readily provides two copies of the sale.

Specifically, in a "point of sale" transaction, a customer's credit card having a magnetic information stripe is passed through a magnetic reader. Information from the credit card's magnetic stripe, such as the customer's name, account number, card expiration date, etc., is read from the magnetic stripe and this information is then printed onto a multiple-ply carbonless paper roll. At the same time, additional information related to the specific sale, such as merchant's name, items purchased, price, etc., is also printed onto the paper roll. After all of the needed information is printed/imprinted and each ply of the paper roll contains a copy thereof, a sales clerk separates the printed/imprinted portion of the paper roll from the rest of the paper roll. The separated, printed/imprinted portion of the roll, which varies in length from sale to sale, is presented to the customer for signature, after which the two printed/imprinted portions are separated and separate copies containing complete copies of the printed/imprinted statement and customer signature are retained by the sales clerk and the customer, respectively.

In conventional two-ply carbonless paper rolls, the two parts making up the roll are not attached or joined together. Accordingly, as the printed/imprinted portions are separated from the main paper roll, the sales clerk and/or the customer must ensure that both printed/imprinted portions that are separated from the paper roll remain properly aligned when the customer signs the printed/imprinted portion.

In order to provide satisfactory printed/imprinted copies of the sales transaction to both the merchant and customer, it is important that the printed/imprinted portion remain together until it is signed by the customer. It has been found, however, that the small size of the printed/imprinted portions, which have an average length of six inches, and the manual handling of the printed/imprinted portions by the sales clerk and customer interfere with the proper alignment of the printed/imprinted portions. Also, at various merchants, a customer's card must be manually imprinted, which requires that the transaction receipts/copies be properly aligned.

A need exists for a multiple ply carbonless paper roll which maintains the multiple plies of the roll in proper register when the printed/imprinted portion is separated from the paper roll. Moreover, once copies of the sales transaction are printed/imprinted on those portions of the plies and the printed/imprinted portions are separated from the main paper roll, the plies should be readily and conveniently separable from each other after the customer signature is affixed so that separate copies may be available for retention by both the merchant and the customer.

SUMMARY OF THE INVENTION

It is an object of the invention to overcome one or more of the problems described above.

According to the invention, a multiple ply paper roll includes at least top and bottom plies with the top ply disposed over and in register with the bottom ply along respective longitudinal edges of the plies when the plies are wound onto a roll and printed (and imprinted). Each of the plies has upper and lower surfaces and the plies in combination are capable of transferring an image from at least one ply surface on one ply to at least one ply surface of another ply.

The roll further includes an adhesive adapted to releasably join the ply surfaces to each other along at least one longitudinal edge of the plies.

Preferably, the plies are adhesively joined along only one of the two edges of the roll.

Other objects and advantages of the invention will be apparent to those skilled in the art from a review of the following detailed description taken in conjunction with the drawings and the appended claims.

DETAILED DESCRIPTION OF THE INVENTION

According to the invention, a multiple-ply carbonless paper roll suitable for use in point of sale printing equipment is provided. The roll comprises overlapping wound plies capable of being separated into a plurality of imprintable forms, wherein each such form is adapted to be removed from the roll. The roll comprises at least a top and a bottom ply, each of which defines at least one longitudinal edge in register with a corresponding longitudinal edge of another ply, and with the top ply being disposed over and in register with the bottom ply. Optionally, one or more intermediate plies are disposed between and in register with the top and bottom plies along a longitudinal edge defined by each intermediate ply.

Each of the plies defines respective upper and lower surfaces. The plies in combination are capable of transferring an image from at least one of the ply surfaces on one ply to at least one of the ply surfaces of another ply. Adhering means (e.g., a liquid adhesive) is applied to the roll along at least a longitudinal edge of the wound plies for adhering the plies to one another and for permitting the plies to be releasably separable from the roll and from one another.

In one embodiment, at least one surface of each ply is coated with a carbonless image producing agent and, in a preferred form, at least the bottom surface of one ply and an adjacent upper surface of another ply are coated with a carbonless image producing agent.

In another form of the invention, the carbonless image producing agent comprises a so-called "self contained" coating, while in other forms, respective adjacent surfaces are coated with so-called "CF" (coated front) and "CB" (coated back) coatings.

Where CF and CB coatings are utilized, the adhering means is disposed on the coated ply surfaces and not on uncoated ply surfaces. Where so-called self contained coatings are used, the adhering means may be disposed on all of the ply surfaces. The invention also provides a method of maintaining a roll of overlapping wound plies in register with each other to permit the registered plies to be unwound from the roll after a retail transaction and separated into a plurality of imprintable forms by the step of applying adhering means to the roll along at least a side thereof.

Figure 1:
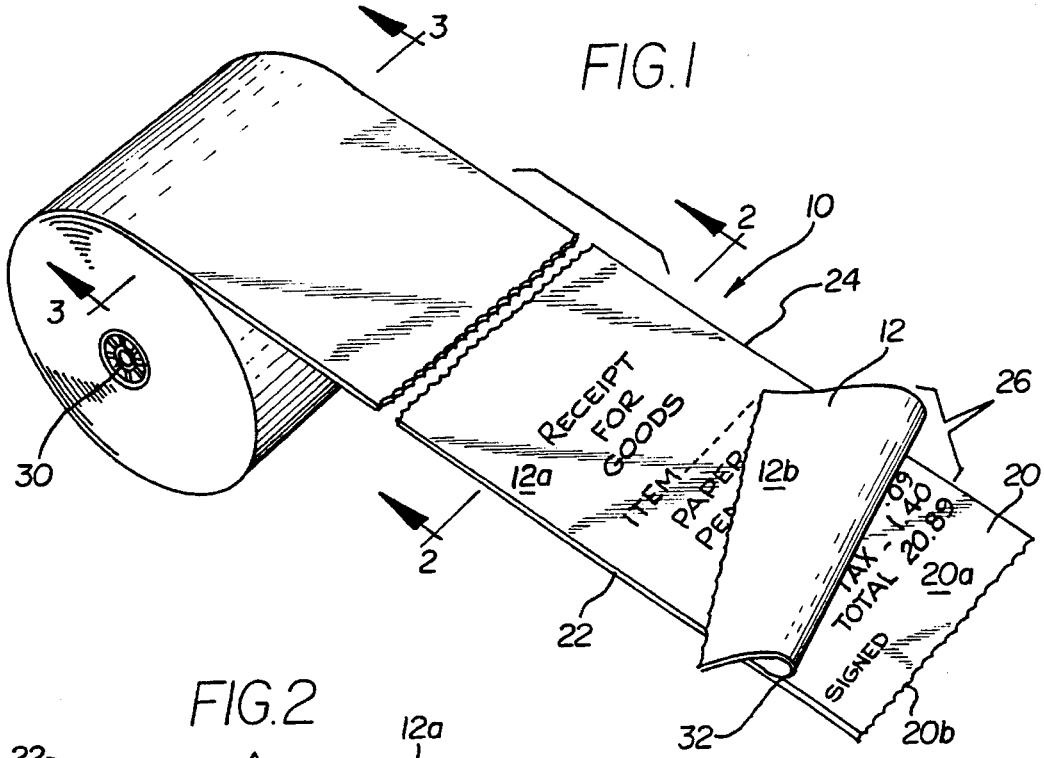
FIG. 1 is a perspective view of a two-ply carbonless paper roll of the invention in which a top and a bottom ply are joined to each other along one of the two longitudinal edges of the roll.

As illustrated in FIG. 1, a two-ply carbonless paper roll, generally designated 10, includes a top ply 12 defining respective upper and lower ply surfaces 12*a* and 12*b* overlying and in register with a bottom ply 20, which defines respective upper and lower ply surfaces 20*a* and 20*b*. The rolls generally are approximately 3 inches wide with the outside diameter of a wound roll being approximately 2½ to 3½ inches. It is appreciated that the size of the roll can vary depending upon a particular application. The plies 12 and 20 are releasably joined along a longitudinal edge 22 of the roll 10 but, in this particular embodiment, the plies are not joined along a second longitudinal edge 24. When wound, the registered edges 22 form an edge 22' of the roll 10. Together, the plies 12 and 20 define an imprintable form, generally designated 26. The plies 12 and 20 are wound about a core, illustratively a plastic or fiber spool 30.

Figure 2:
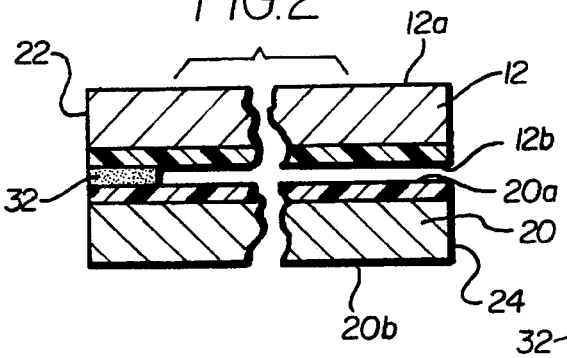
FIG. 2 is a sectional view of the two-ply carbonless paper roll of FIG. 1 taken along section lines 2—2 of FIG. 1.

As illustrated in FIG. 2, the surfaces 12*b* and 20*a* are coated with carbonless chemical image producing agents (described below) and the surfaces 12*a* and 20*b* are free of such carbonless coatings. The top ply 12 is adhesively joined to the bottom ply 20 with a small amount of an adhesive 32 along the edge 22. As seen in FIG. 2, for example, the thin layer of adhesive extends inwardly from the edge 22 toward the middle of the plies 12 and 20 far enough for the plies 12 and 20 to be joined together but still being capable of being readily separated by pulling the top ply 12 from the bottom ply 20. Preferably, the adhesive penetrates from the edge 22 inwardly between about 1/64 to 1/32 inch. It is preferable to have the least amount of inward penetration of the adhesive as possible, while at the same time having a form 26 which will be satisfactorily releasably joined along the edge 22.

Figure 3:
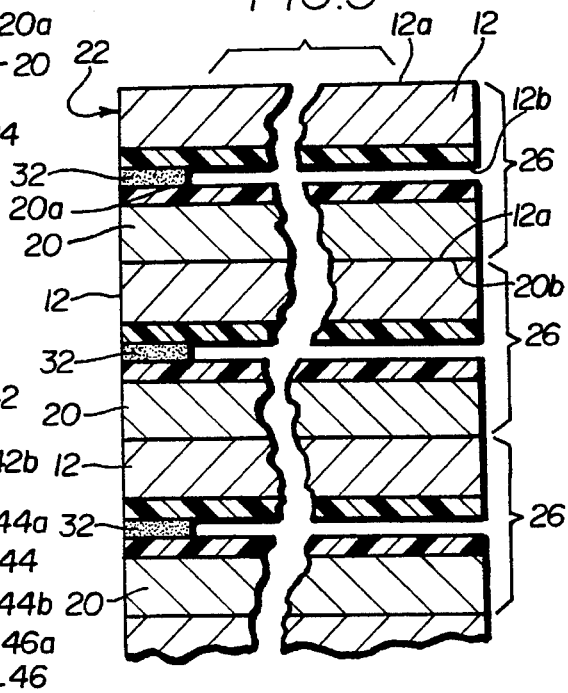
FIG. 3 is an edge view of the two-ply carbonless paper roll of FIG. 1 taken along section lines 3—3 of FIG. 1.

As illustrated in FIG. 3, when the plies 12 and 20 are wound into the roll 10, the two plies 12 and 20 form alternating layers with the top ply 12 being the outermost or top layer. The bottom ply 20 lies directly underneath the top ply 12 and is also disposed over the next underlying top ply 12. This pattern repeats itself throughout the roll 10.

Beginning with the uppermost top ply 12, there is a small amount of adhesive 32 disposed along the edge 22 between the lower surface 12*b* of each top ply 12 and the upper surface 20*a* of each bottom ply 20. Notably, there is no layer of adhesive between the lower surface 20*b* of each bottom ply 20 and the adjacent upper surface 12*a* of each top ply 12. Accordingly, the plies 12 and 20 are readily unwound together from the roll 10, but the adhesive 32 keeps each top ply 12 joined to a bottom ply 20 when such plies are separated from the roll.

Figure 4:
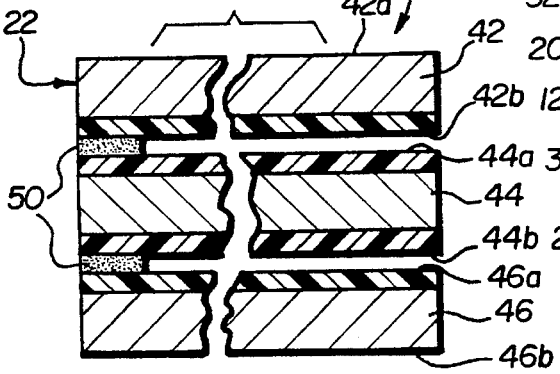
FIG. 4 is a sectional view of a three-ply form of a carbonless paper roll of the invention.

An embodiment of the invention having three plies is illustrated in FIG. 4. In FIG. 4, a three-ply roll 40 includes three carbonless paper plies 42, 44 and 46 each of which defines upper and lower surfaces 42*a* and 42*b*, 44*a* and 44*b*, and 46*a* and 46*b*, respectively. The top ply 42 is preferably a coated back ply disposed over the intermediate ply 44, which is a coated front and back ply disposed over the bottom ply 46, which, in turn, is a coated front ply. A respective layer of adhesive 50 releasably joins the intermediate ply 44 to both the top ply 42 and bottom ply 46. The adhesive layer 50 extends inwardly from the edge 22 between the surfaces 42*b* and 44*a* and between the surfaces 44*b* and 46*a* toward the middle of the plies far enough for the plies 42, 44, and 46 to be joined together but still remain capable of being readily separated by pulling one ply away from another ply. Preferably, the adhesive layer 50 penetrates from the edge 22 inwardly between about 1/64 to 1/32 inch. Notably, when the three plies are wound onto a roll, there is no adhesive bond between the lower surface 46*b* of the bottom ply 46 and the upper surface 42*a* of the adjacent intermediate ply 42. Thus, the three plies may be easily unwound from the roll 40 but the layer of adhesive 50 keeps the plies 42, 44, and 46 joined when a portion of the plies is separated from the roll 40.

According to the invention, the plies 12, 20, 42, 44, and 46 are so-called carbonless paper plies. Carbonless papers are papers coated with carbonless image producing agents. The phrase "carbonless image producing agents," as used herein, includes any system of colorless dyes that chemically react to form a color when placed in contact with a reactive agent. Such carbonless image producing agents generally comprise a two-part system. One part of such a system includes chemically reactive, colorless dyes which are contained in rupturable microcapsules. The other part of such a system includes a coatable reactive resin which reacts on contact with the colorless dye to develop a visible color. To produce an image with such a two-part system, a surface of a first paper is coated with the microencapsulated colorless dyes while a surface of a second paper is coated with the reactive resin. To produce an image, the coated surfaces of the first and second papers are brought together and pressure sufficient to rupture the microcapsules is applied. When the microcapsules rupture, the colorless dyes are released and react with the reactive resin to form an image on the surface of the resin coated paper.

Conventionally, the bottom surfaces of CB paper are coated with the microencapsulated colorless dyes, and the top surfaces of CF paper are coated with the reactive resin. In addition, CFB paper is coated on one surface with the reactive resin and on the opposing surface with the microencapsulated dyes.

Carbonless papers coated with such carbonless image producing agents that are suitable for use in the present invention are described in U.S. Pat. No. 3,981,523, for example, the disclosure of which is incorporated by reference herein. Other commercially available carbonless papers are sold under the trademark NCR PAPER®, by Appleton Paper Inc. of Appleton, Wis. Compatible carbonless papers are also produced by other manufacturers such as Moore Business Forms, 3M, Mead Paper and others.

Useful adhesives include liquid adhesive compositions commonly used to edge-pad collated stacks of carbonless paper. Such liquid adhesive compositions are generally aqueous compositions which include a water-based latex adhesive polymer, a glycol and an alcohol. Suitable latex adhesives include poly(ethylacrylate/methacrylate), Poly-(ethylacrylate/N-methlolacrylamide) and poly(ethylene/vinyl acetate). Such liquid adhesive compositions are described in U.S. Pat. No. 5,079,068 issued Jan. 2, 1992 as well as in International application PCT/US91/04760 published Jan. 23, 1992, the disclosures of which are incorporated by reference herein. Commercially available liquid adhesive compositions include: MEAD FAN-APART ADHESIVE marketed by the Fine Paper Division of Mead Paper Corporation (Chillicothe, Ohio), FANAPART HIGH STRENGTH PADDING ADHESIVE marketed by Appleton Papers, Incorporated (Appleton, Wis.) and FAN-OUT PADDING ADHESIVE marketed by 3M (St. Paul, Minn.).

Figure 5:
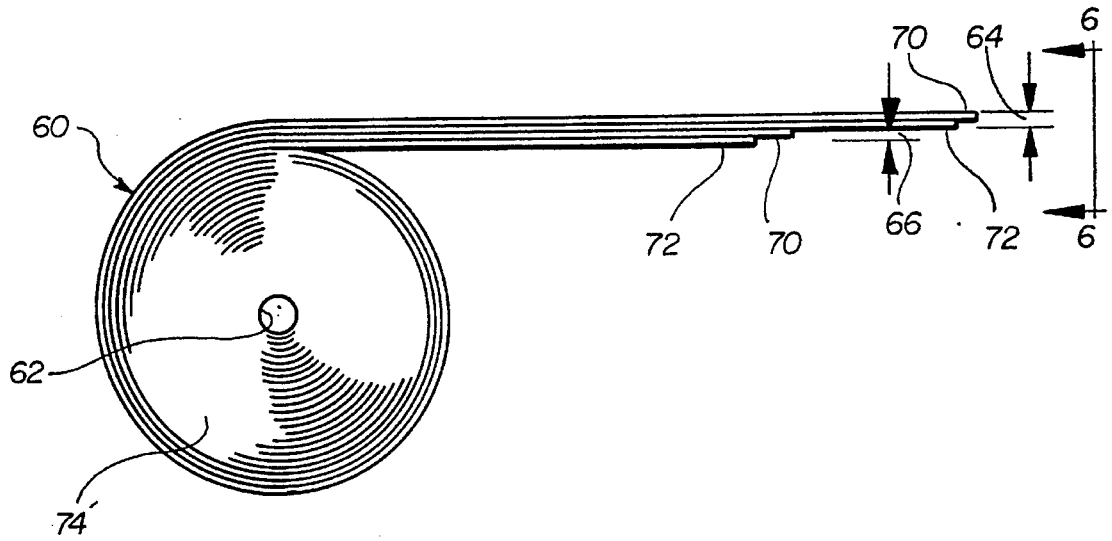
FIG. 5 is an elevation view of a multi-form embodiment of a carbonless paper roll of the invention.
Figure 6:
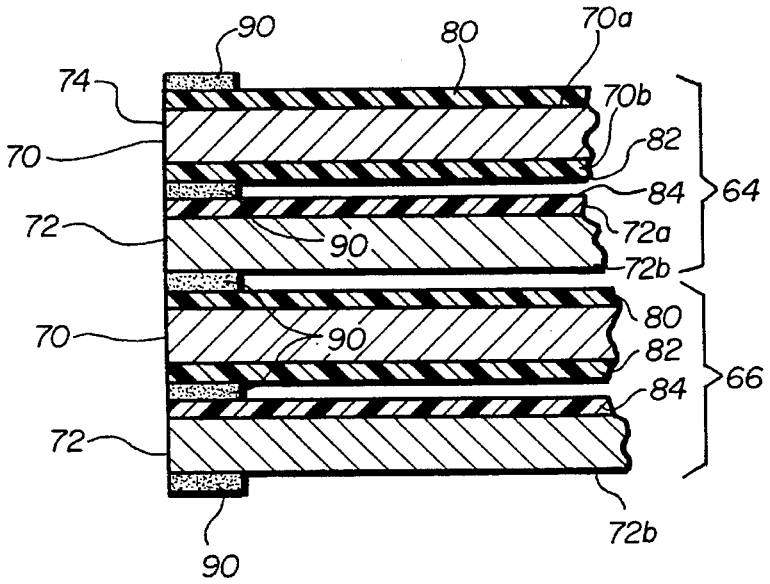
FIG. 6 is a sectional view of the paper roll of FIG. 5 taken along section lines 6—6 in FIG. 5.

FIGS. 5 and 6 illustrate another embodiment of the invention utilizing so-called "SCCB" (self contained/coated back) and CF papers in a roll of two ply forms with adhesion between forms.

FIGS. 5 and 6 depict a paper roll 60 wound about a core 62 and defining a plurality of two ply forms 64 and 66. Each form 64 comprises a top ply 70 and a bottom ply 72. The plies 70 and 72 are in register with each other along a longitudinal edge 74 defined on each ply 70 and 72. The wound forms 64 and 66 define a side 74' of the paper roll 60 along the ply edges 74.

Each ply 70 and 72 defines respective upper surfaces 70*a* and 72*a*, and bottom surfaces 70*b* and 72*b*, respectively. Each upper ply 70 is coated on its upper surface 70*a* with a layer 80 of so-called "self contained" colorless image producing agent, and is coated on its lower surface 70*b* with a layer 82 of CB colorless chemical image producing agent.

Each lower ply 72 is coated along its upper surface 72*a* with a layer 84 of CF carbonless image producing agent. Each lower surface 72B of each bottom ply 72 is free of any carbonless image producing agents.

Respective thin layers of adhesive 90 are disposed between respective pairs of CB layer 82 and CF layer 84 and between SC layer 80 and an overlying ply surface 72*b* which is free of carbonless image producing agent.

Unlike the adhesive layers 32 and 50 depicted in FIGS. 2–4, the adhesive of the layers 90 is selected for its capability of adhering to CB and CF coated surfaces, self-contained coated surfaces, and uncoated surfaces. Thus, good interlayer adhesion between the top and bottom plies 70 and 72 of a form 64 or 66 is provided, as well as good interform adhesion between the bottom ply 72 of an overlying form 64 and an upper ply 70 of an underlying form 66.

One useful liquid adhesive for forming the adhesive layers 90 is a conventional padding compound sold by the HB Fuller Company, Item No K3788. Excellent results have been obtained using the commercially available K3788 padding compound in diluted form, from about 30 vol. % water to about 70 vol. % water, with best results obtained in a 50 vol. % water/50 vol. % padding compound mixture.

This type of adhesive bonds to both CB and CF coated sheets, including CFB sheets as well as SC and SCCB sheets, and uncoated sheets, yet, the bond is satisfactory in being readily and easily releasable when it is desired to release the ply 70 from the ply 72 of illustrative forms 64 or 66. Therefore, it is possible to make multi-ply forms incorporating any number of intermediate CFB coated sheets between the upper SCCB ply and the lower CF ply having an uncoated lower surface.

Another embodiment of the invention utilizes a bond paper (normally uncoated 15# white paper commonly referred to as adding machine paper, cash register paper or plain bond paper) as the top ply and an SC paper (self-contained) as the bottom ply in a roll of two-ply forms with adhesion between forms. A roll using the padding compound liquid adhesive available such as MEAD FAN-APART ADHESIVE, Appleton's FANAPART HIGH STRENGTH PADDING ADHESIVE or 3M's FAN-OUT PADDING ADHESIVE will provide good interlayer adhesion between the top and bottom plies throughout the roll.

EXAMPLE

The following example describes a two-ply padded paper roll in accordance with one embodiment of the invention.

This example provides a two-ply carbonless paper roll suitable for use in most standardized point of sale printing equipment such as VeriFone Printer 250. According to well known procedures, a large roll of coated back (CB) white 14.3 lb paper stock (approximately 50" wide×40" outside diameter) sold by Appleton/NCR, Appleton, Wis. and a large roll of coated front (CF) canary 13.5 lb paper stock (approximately 50" wide×40" outside diameter) sold by Appleton/NCR, Appleton, Wis. were both slit and rewound onto 7/16 inch diameter and 3 inch wide plastic spools using slitter/rewinder equipment manufactured and sold by the Jennerjahn Company (Indiana) to form approximately three (3) inch wide small paper rolls having the white CB paper ply disposed on top of and in register with the canary CF paper ply. Each small roll contained approximately 100 feet of both white and canary paper and is approximately three (3) inches in diameter.

The rewound rolls were removed from the slitter/rewinder equipment and one flatside edge of each rewound roll was contacted with a sponge soaked in a liquid adhesive composition sold as FAN-OUT PADDING ADHESIVE, by 3M Company (St. Paul, Minn.). The liquid adhesive composition is believed to have the following composition:

FAN-OUT PADDING ADHESIVE

| Component | WT. % |
|---|---|
| poly(vinyl acetate) stabilized with surfactant | 9 |
| poly(vinyl alcohol) | 4.5 |
| ethyl alcohol | 28 |
| crystalline sorbitol, 4000 NF | 1.25 |
| water | 57.25 |

Each (white/canary) small roll was contacted with the soaked sponge for about two seconds on one flatside edge, which is the edge of the roll formed by the edges 22 of individual, overlapped plies, using moderate pressure and slight rotation to ensure adequate, uniform contact of the edge of the roll with the liquid adhesive composition. The liquid adhesive composition penetrated into the roll approximately 1/64 to 1/32 inch. After contact with the liquid adhesive composition, the paper rolls were dried, at room temperature, adhesive treated edge up, for about 15–20 minutes after which they can be boxed for shipping.

If desired, the liquid adhesive padding compound can be applied by any number of methods aside from the sponge contact method. For example, the padding compound can be applied by a brush or it can be sprayed onto the flatside edge and can be dried by any number of methods known in the art such as air blow drying or heat and blow drying.

Similarly, while the invention has been illustrated with adhesive layers 32, 50 and 90 contacting the various plies along the registered edge or side 22' (FIG. 1) or the side 74' (FIG. 5), it is appreciated that, if desired, the remaining registered edge or side of the roll embodiment of FIG. 1 or the remaining registered edge or side of the roll embodiment in FIG. 5 could have padding compound applied to it so that the plies were releasably joined along the edges 22 and 24 in the embodiment of FIG. 1 and also both edges of the roll embodiment shown in FIG. 5.

While several form embodiments have been disclosed, it is appreciated forms comprising other types of plies could be utilized. For example, a two-ply roll in which one ply contained bond paper without any carbonless image producing agents could be used in association with a second ply, generally located beneath the first ply, wherein the second ply included a top ply surface having a self-contained (SC) coated surface.

The foregoing detailed description has been given for clearness of understanding only, and no unnecessary limitation would be understood therefrom as modifications with the scope of the invention will be apparent to those skilled in the art.

I claim:

1. A roll of overlapping wound plies capable of being separated into a plurality of imprintable forms, each said form being adapted to be removed from said roll, said roll comprising:

(a) a top ply and a bottom ply, each of said plies defining at least one longitudinal edge in register with a corresponding longitudinal edge of another ply;

(b) said top ply being disposed over and in register with said bottom ply and at least one surface of said top and bottom plies being coated with a carbonless image producing agent;

(c) optionally, one or more intermediate plies disposed between and in register with said top and bottom plies along a longitudinal edge defined by each said intermediate ply, each of said top, bottom and any intermediate plies defining respective upper and lower surfaces, said plies in combination being capable of transferring an image from at least one of said ply surfaces on one ply to at least one surface of another ply; and (d) adhering means applied to said roll along at least said registered longitudinal edge of said wound plies for adhering said plies to one another and for permitting said plies to be releasably separable from said roll and from each other.

2. The roll of claim 1 wherein at least one surface of each ply is coated with a carbonless image-producing agent.

3. The roll of claim 2 wherein at least the bottom surface of one of said plies and an adjacent upper surface of another of said plies are coated with a carbonless image-producing agent.

4. The roll of claim 2 or 3 wherein said adhering means is disposed on at least said coated ply surfaces.

5. The roll of claim 2 or 3 wherein said adhering means is disposed on each of said ply surfaces.

6. The roll of claim 2 or 3 wherein at least one ply surface is free of said carbonless image-producing agent and said adhering means.

7. The roll of claim 1, 2, or 3 wherein said adhering means is an adhesive applied to said longitudinal edge as a liquid.

8. A method of maintaining a roll of overlapping wound plies in register with each other to permit said registered plies to be unwound from said roll and separated into a plurality of imprintable forms wherein each form comprises a top ply, a bottom ply, said top and bottom plies each having at least one surface coated with a carbonless image producing agent, and, optionally, one or more intermediate plies, said intermediate plies being free of a recess; each of said plies defining at least one longitudinal edge in register with a corresponding longitudinal edge of another ply, said top ply being disposed over and in register with said bottom ply, and said overlapped, registered longitudinal ply edges forming one side of said roll when said plies are overlapped and wound together, said method comprising the step of applying adhering means to one side of said registered plies, including said top and bottom plies, while said plies are wound in a roll whereby said adhering means adheres a wound ply to an adjacent wound ply along at least said registered ply edges.

9. The method of claim 8 wherein said plies each include at least one surface coated with a carbonless image-producing agent and comprising the further step of applying said adhering means on said coated surfaces.

10. The method of claim 9 wherein said adhering means is applied to said coated and uncoated ply surfaces.

11. The method of claim 8, 9 or 10 in which said rolls includes a second side which is spaced from said first side and said adhering means is an adhesive liquid, and said adhesive liquid is applied to both sides of said roll.

12. A roll comprising at least one imprintable form, each said form comprising:

(a) a top ply and a bottom ply, each of said top and bottom plies defining at least one longitudinal edge in register with a corresponding longitudinal edge of the other top or bottom ply, said top ply being disposed over said bottom ply, and each of said top and bottom plies defining respective upper and lower surfaces;

(b) said top ply lower surface and said bottom ply upper surface being coated with a carbonless image producing agent;

(c) at least one of said top ply upper and said bottom ply lower surfaces being free of carbonless image producing agent;

(d) optionally, one or more intermediate plies disposed between and in register with said top and bottom plies, each said intermediate ply defining a longitudinal edge in register with the corresponding longitudinal edges of said top and bottom plies and further defining an upper surface and a lower surface coated with a carbonless image producing agent;

(e) means for releasably adhering said lower coated surface of said top and any intermediate plies to an adjacent upper coated surface of said bottom ply and any intermediate ply along at least said longitudinal edges of said plies without adhering a coated surface to an adjacent surface free of carbonless image producing agents; and (f) wherein each said coated surface is releasably adhered to an adjacent coated surface along at least one of said longitudinal edges without adhering a coated surface to an adjacent surface free of carbonless image producing agent;

whereby said form having said releasably joined plies can be unwound and removed from said roll free of adhering to said remaining portion of said roll.

13. The roll of claim 12 wherein each said top ply, bottom ply, and any intermediate ply defines two longitudinal edges in register with corresponding longitudinal edges of the other plies in said roll, each said coated surface being releasably adhered to an adjacent coated surface along each said longitudinal edge without adhering a coated surface to an adjacent surface free of carbonless image producing agent.

14. The roll of claim 12 or 13 comprising a plurality of said imprintable forms stacked in superimposed relation to one another and wound in the form of said roll.

15. The roll of claim 12 or 13 wherein said adhesive means comprises a liquid adhesive applied to said longitudinal edge of said roll.

16. The roll of claim 15 wherein said plies each include two spaced longitudinal edges and both said longitudinal edges are contacted by said adhesive means.

17. The roll of claim 12 or 13 wherein said roll is between 2½ and 3½ inches wide and has an outside diameter of between 2 and 3 inches.

18. The roll of claim 17 wherein said adhesive means extends inwardly from said longitudinal edge approximately 1/32 to 1/64 inch.

19. The roll of claim 12 wherein said roll includes three plies releasably adhered, one ply to another ply, along one edge of each of said plies.

20. The roll of claim 1 where one of said plies is a bond paper and said remaining ply is a self-contained ply.

21. The roll of claim 20 wherein said bond paper is said top ply and said self-contained ply is said bottom ply.

22. The roll of claim 12 wherein said intermediate plies are free of any recess for receiving said adhering means.

* * * * *